United States Patent [19]

Muehling

[11] Patent Number: 4,524,519

[45] Date of Patent: Jun. 25, 1985

[54] CONTINUOUS LOOP FLEXIBLE SAW

[76] Inventor: Anthony A. Muehling, 14583 Maddelein, Detroit, Mich. 48205

[21] Appl. No.: 590,918

[22] Filed: Mar. 19, 1984

[51] Int. Cl.[3] ..... B27B 17/02

[52] U.S. Cl. ..... 30/382; 83/545; 83/832; 83/DIG. 1

[58] Field of Search ..... 30/381, 382, 383; 83/831, 832, 833, 834, 545, DIG. 1

[56] References Cited

U.S. PATENT DOCUMENTS

| | | | |
|---|---|---|---|
| 1,634,643 | 7/1927 | Bens | 83/832 |
| 1,652,295 | 12/1927 | Bens | 83/832 |
| 2,348,612 | 5/1944 | Deacon | 30/382 |
| 2,774,395 | 12/1956 | Tweedie | 83/831 X |
| 4,118,995 | 10/1978 | Lanz | 83/831 X |
| 4,193,193 | 3/1980 | Holzworth | 30/382 |
| 4,387,615 | 6/1983 | Lemery | 83/833 |

*Primary Examiner*—Jimmy C. Peters
*Attorney, Agent, or Firm*—Brooks & Kushman

[57] ABSTRACT

A flexible saw is disclosed, including a plurality of toothed cutting links forming a continuous loop wherein the cutting links are arranged in two side-by-side rows with the cutting links in a staggered relationship. The links of each row each have opposite ends, respectively, aligned with the opposite ends of a pair of adjacent links of the other row. Rivets pivotally connect the aligned ends of the cutting links directly to each other. The flexible loop is mounted on a guide bar. The cutting links of each row each have a cutting tooth which extends away from the links of the other row. A safety bar is located between the teeth of the two rows of links to provide protection against accidental cutting.

14 Claims, 8 Drawing Figures

CONTINUOUS LOOP FLEXIBLE SAW

TECHNICAL FIELD

This invention relates to flexible saws and, in particular, to flexible saws including a continuous loop of cutting links.

BACKGROUND ART

Devices for cutting wood trees and shrubs number in the thousands. Among these are electric and gasoline engine powered chain saws.

A typical saw chain comprises alternating right and left hand cutters separated by blank links. The cutters and blank links are fastened to one another by rivets with concentric shoulders providing separation between opposed or tie straps and cutters. This allows the elements to rotate at the riveted joints. The blank links comprise paired opposed tie straps joined by rivets. The cutters are opposed by tie straps and joined by the rivets.

The United States Patent to Lanz et al U.S. Pat. No. 4,118,995 discloses an integral tie strap and rivet assembly for saw chains. A chain is assembled by placing rivets through drive links and placing either cutters or blank tie straps on the other side. The rivets are then spun to form heads to thereby join the elements together.

DISCLOSURE OF THE INVENTION

An object of the present invention is to provide an improved continuous loop flexible saw. In carrying out this object, the advantages achieved are: less power is required for operating the saw and, consequently, the saw is relatively light in weight with a simple and compact construction; the relatively low cost and ease with which the saw may be manufactured; and the ease and safety with which the saw can be used.

In carrying out this object, the flexible saw includes a plurality of cutting links forming a flexible continuous loop having upper and lower reaches and being arranged in two side-by-side rows with the links in a staggered relationship. The links of each row each have opposite ends respectively aligned with the opposite ends of a pair of aligned links of the other row. Pivotal connections connect the aligned ends of the cutting links directly to each other.

Preferably the saw includes a guide bar on which the flexible loop is mounted. The links of each row of the saw each have a cutting tooth that extends away from the links of the other row.

Also preferably, a safety bar is located between the teeth of the two rows of links on the upper reach to provide protection against accidental cutting.

The adjacent side-by-side cutting links are pivotally connected by rivets which are thereafter spun to prevent the rows of cutting links from separating.

Because the cutting links are arranged side-by-side in adjacent rows, it is a relatively simple matter to cut the teeth of the cutting links, as well as to manufacture the continuous loop of cutting links.

The objects, features and advantages of the present invention are readily apparent from the following detailed description of the best mode for carrying out the invention when taken in connection with the accompanying drawings.

Figure 3:
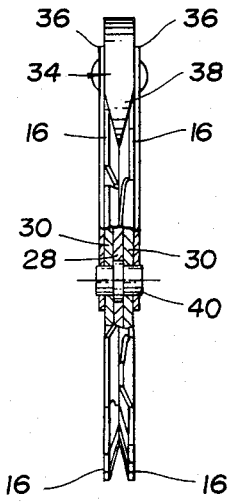
Figure 5:
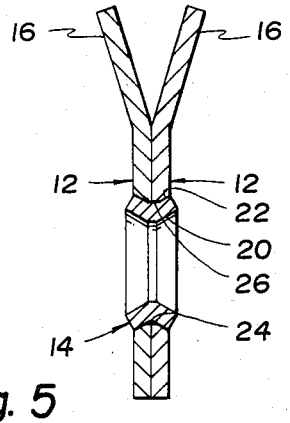
Figure 4:
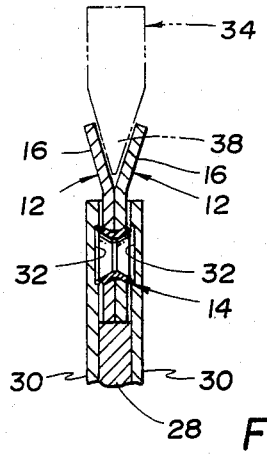
Figure 6:
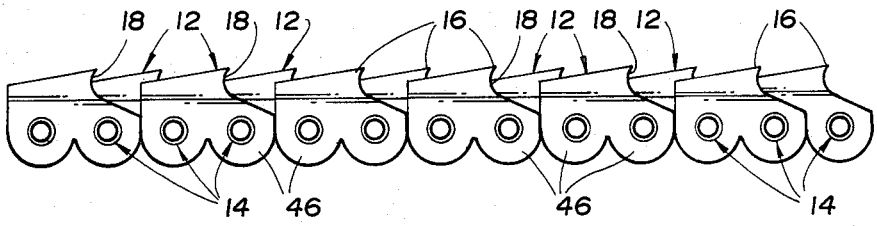
Figure 7:
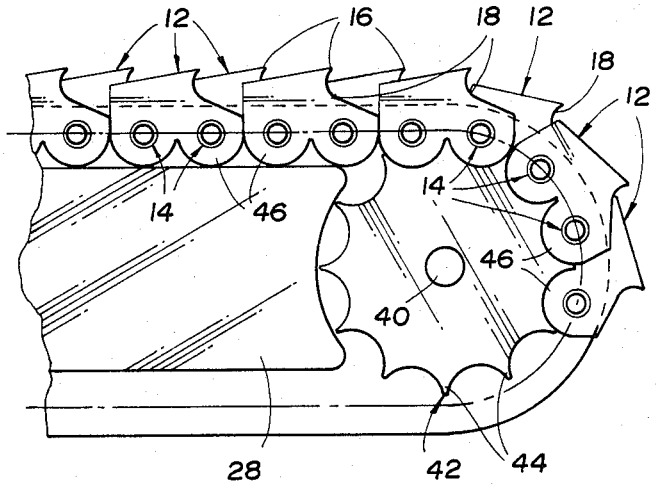

FIG. *2a* is an enlarged view, partially broken away, illustrating one end of the saw, with its associated safety bar;

FIG. *2b* is a side view of a second embodiment of a safety bar, a portion of which functions as a nose guard;

FIG. 3 is an end view of the saw, partially broken away and in cross section;

FIG. 4 is a view, partially broken away and in cross-section, illustrating the sliding interconnection between a continuous loop of cutting links and a guide bar with a safety bar illustrated in phantom;

FIG. 5 is an enlarged cross-sectional view, illustrating a pair of cutting links arranged side-by-side and the pivotal connection therebetween;

FIG. 6 is a side elevational view, illustrating a segment of the continuous loop of cutting links; and FIG. 7 is a view, partially broken away, with a guide plate removed to illustrate engagement of a sprocket wheel of another embodiment with the continuous loop.

BEST MODE FOR CARRYING OUT THE INVENTION

Figure 1:
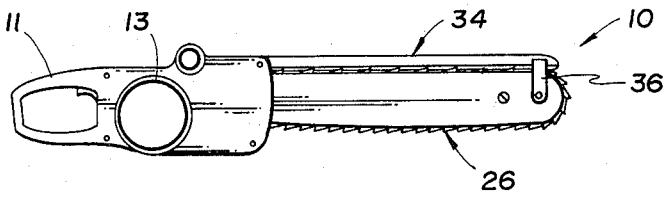
FIG. 1 is a side elevational view of a power chain saw constructed in accordance with the present invention.

Referring now to FIG. 1, an embodiment of a flexible saw constructed in accordance with the present invention, is generally indicated at 10. The flexible saw 10 may be utilized to cut a relatively hard material, such as trees and tree limbs. The chain saw 10 has particular utility with power chain saws, such as gas or electric chain saws. Such chain saws typically include a housing having a handle portion 11 and a motor drive portion 13, in which a sprocket wheel (not shown) is typically included for driving a continuous loop of cutting links. The sprocket wheel, in turn, is mounted on the rotatable shaft of a gas or electric powered motor to rotate therewith.

As best shown in FIGS. 4 through 7, the flexible saw 10 comprises a plurality of toothed, substantially identical cutting links, generally indicated at 12. The cutting links 12 form a flexible continuous loop having upper and lower reaches. The cutting links 12 are arranged in two side-by-side rows with the cutting links 12 in a staggered relationship. The links 12 of each row each have opposite ends respectively aligned with the opposite ends of a pair of adjacent links 12 of the other row. Pivotal connections in the form of rivets, generally indicated at 14, connect the aligned ends of the cutting links 12 directly to each other. The distance between the pivotal connections on one link 12 is substantially equal to the distance between the pivotal connections on a pair of adjacent links in a row.

Figure 2A:
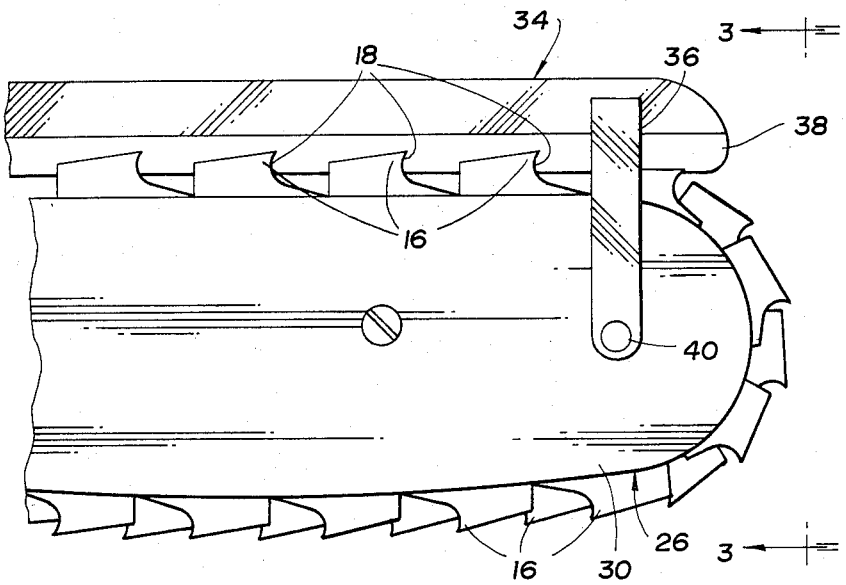

Each cutting link 12 includes a cutting tooth 16 which has a curved cutting surface 18 formed on one edge thereof. The teeth 16 cut into an object to be cut upon clockwise rotation of the continuous loop of cutting links 12 as shown in FIG. 2.

The teeth 16 on one row of cutting links 12 are bent away from the teeth 16 on the other row of cutting links 12. In this way, the width of the teeth 16 is sufficient to produce a kerf in the object being cut which is wider than the average width of the continuous loop of cutting links 12 to prevent binding therein. However, the width of the kerf is less than that provided by conventional saws, thereby requiring less power.

Referring now to FIG. 5, a pivotal connection including the rivet 14 is shown interconnecting the aligned ends of a pair of adjacent cutting links 12. The rivet 14 extends through the adjacent links 12 and includes an inner sloping surface 20 and an outer sloping surface 22. The ends of each rivet 14 are spun to hold the adjacent links 12 together after insertion of the rivet 14 in a passage 24 defined by the two adjacent cutting links 12 when aligned. The heat-treated adjacent cutting links 12 produce a small amount of clearance between themselves and the rivet 14 to thereby form a suitable running fit. In this way, lubrication is easily provided. The angle included by the outer surfaces 22 of the rivet 14 is preferably larger by approximately 5° than the angle included by the inner surfaces 20 in order to tightly secure the adjacent cutting links 12 together.

The immediately adjacent surfaces 26 of the cutting links 12 which define the hole 24 are substantially flat so that during the cutting motion of the saw 10, the surfaces 26 do not cut into the rivet 14 but rather distribute the shear force developed between the cutting links 12 against the surface 22 of the rivet 14.

Referring again to FIGS. 1 through 3 and FIG. 7, the saw 10 preferably further comprises a guide bar, generally indicated at 26, on which the flexible loop of cutting links 12 is mounted. The guide bar 26 includes a central rest plate 28 and a pair of spaced guide plates 30 mounted on opposite sides of the rest plates 28, such as by spot welding. The rest plate 28 and the side guide plates 30 define a slide path about the outer periphery of the rest plate 28 for slidably receiving the continuous loop of cutting links 12. The teeth 16 of the cutting links 12 extend away from the rest plate 28 and above the top surfaces of the guide plates 30.

As shown in FIG. 4, the side guide plates have opposing races or grooves 32 formed therein for receiving the opposite ends of the rivet 14. The grooves 32 slidably receive and retain the ends of the rivets 14 about the entire outer periphery of the guide plates 30.

As shown in FIGS. 1 through 4, the saw 10 includes a safety bar, generally indicated at 34, which is located adjacent the teeth 16 of the two rows of cutting links 12 on the upper reach of the continuous loop to provide protection against accidental cutting and protection against "fly-back" in case of chain breakage. The safety bar 34 includes an integrally formed, wedge-shaped, lower edge portion 38, which is located between the teeth 16 of the two rows of cutting links 12 on the upper reach of the loop. The safety bar 34 is mounted at one end thereof to the housing and at its free end to the guide plates 30 at a shaft 40 by a pair of spaced mounting links 36. The mounting links 36 are of spring steel and are spot welded to the safety bar 34 at one end thereof. At their opposite ends, the links 36 are apertured to slip over the ends of the shouldered shaft 40. The safety bar 34 may be removed by disconnecting the bar 34 at the housing and springing off the links 36. The loop of cutting links 12 may also be replaced in this fashion. While not shown, the tension of the loop of cutting links 12 may be adjusted within the housing.

In the embodiment of FIG. 7, a sprocket wheel, generally indicated at 42, is mounted on the shaft 40. The shaft 40 is pivotally mounted at its opposite ends to the guide plates 30. The sprocket wheel 42 includes a plurality of outer peripheral teeth 44 which are adapted for engagement with the cutting links 12 of the loop. In particular, each of the cutting links 12 includes a scalloped inner end portion 46 for receiving the teeth 44 of the sprocket wheel 42 therebetween and between the scalloped portions 46 of adjacent links in a row. As is well known in the art, the sprocket wheel 42 increases the cutting efficiency of the saw 10.

Figure 2B:
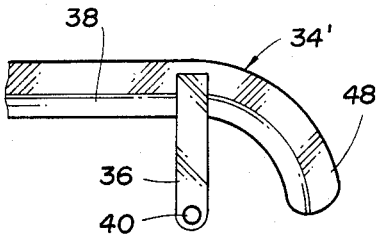

Also, as shown in FIG. 2*b*, the saw 10 may include a safety bar 34' having a free end portion which serves as a nose guard 48. The nose guard 48 protects the teeth 16 of the cutting links 12 between the upper and lower reaches of the continuous loop of cutting links 12.

The flexible saw 10 described above includes numerous cutting teeth 16 per unit length of the continuous loop of cutting links 12. Consequently, only a relatively small amount of power is required to rotate the continuous loops of cutting links 12.

Also, because the cutting links 12 are provided in two side-by-side rows, the continuous loop of cutting links 12 may be manufactured more easily and in a less costly fashion than conventional continuous loops of cutting links. Consequently, increased cutter efficiency and cutting power is achieved. Also, the saw 10 has the additional safety feature in the form of the safety bar 34 or 34'.

While a preferred embodiment of a flexible chain saw has been shown and described herein in detail, those skilled in this art will recognize various alternative designs and embodiments for practicing the present invention as defined by the following claims.

What is claimed is:

1. A chain saw comprising:

a plurality of toothed cutting links forming a flexible continuous loop having upper and lower reaches and being arranged in two side-by-side rows with the links in a staggered relationship; the links of each row each having opposite ends respectively aligned with the opposite ends of a pair of adjacent links of the other row; pivotal connections that connect the aligned ends of the cutting links directly to each other; a guide bar on which the flexible loop is mounted, the links of each row of the saw each having a cutting tooth that extends away from the links of the other row to define a space that separates the teeth of the two rows of links, and a safety bar at least a portion of which is located in the space that separates the teeth of the two rows of links on the upper reach to provide protection against accidental cutting.

2. The invention of claim 1 wherein said guide bar includes a central rest plate and a pair of spaced guide plates mounted on opposite sides of said rest plate for defining a slide path about the outer periphery of said rest plate for said continuous loop, said teeth extending away from said rest plate and away from the outer peripheral surfaces of said guide plates.

3. The invention of claim 1 or claim 2 wherein each of said pivotal connections includes a rivet which extends through adjacent links of the two rows.

4. The invention of claim 3 wherein each of said rivets is hollow and has inner and outer sloping side surfaces and wherein the angle included by the inner side surfaces is greater than the angle included by said outer side surfaces.

5. The invention of claim 3 wherein each rivet extends through a hole defined by inner surfaces of adjacent links of the two rows and wherein immediately adjacent surfaces of the inner surfaces of the adjacent links are substantially flat.

6. The invention of claim 3 wherein said guide plates define a race for slidably receiving and retaining said rivets therein.

7. The invention of claim 2 wherein said safety bar includes a wedge-shaped lower edge portion located between the teeth of the two rows of links on the upper reach.

8. The invention of claim 2 wherein said safety bar includes a free end portion and wherein said invention further includes mounting links for mounting the free end portion of said safety bar on said guide plates.

9. The invention of claim 2 including a sprocket having a plurality of outer peripheral teeth rotatably mounted between said guide plates for engaging the cutting links of the loop.

10. The invention of claim 2 wherein said safety bar includes a free end portion and wherein said invention further includes mounting links for mounting the free end portion of said safety bar to said guide plates at an attachment location and a sprocket wheel having a plurality of outer peripheral teeth rotatably mounted between said guide plates at said attachment location for engaging the cutting links of the loop.

11. The invention of claim 10 wherein said safety bar includes a nose guard portion for protecting the teeth of the links between the upper and lower reaches of the continuous loop.

12. The invention of claim 9 wherein each of said cutting links includes a scalloped inner end portion for receiving the teeth of the sprocket wheel therebetween and between the scalloped portions of adjacent links in one row.

13. The invention of claim 1 wherein the distance between the pivotal connections on one link is substantially equal to the distance between the pivotal connections of a pair of adjacent links in a row.

14. A chain saw comprising:

a plurality of cutting links forming a flexible continuous loop having upper and lower reaches and being arranged in two side-by-side rows with the links in a staggered relationship; the links of each row each having opposite ends respectively in line with the opposite ends of a pair of adjacent links of the other row; pivotal connections each including a rivet which extends through adjacent links of the two rows that connect the aligned ends of the cutting links directly to each other; a guide bar on which the flexible loop is mounted, the links of each row of the saw each having a cutting tooth that extends away from the links of the other row to define a space that separates the teeth of the two rows of links; and a safety bar at least a portion of which is located in the space that separates the teeth of the two rows of links on the upper reach to provide protection against accidental cutting.

* * * * *